United States Patent [19]

Musgrave

[11] 4,138,044

[45] Feb. 6, 1979

[54] PISTOL CHARGING HOLSTER

[76] Inventor: Daniel D. Musgrave, 8201 Carawat St., Cabin John, Md. 20731

[21] Appl. No.: 843,231

[22] Filed: Oct. 18, 1977

[51] Int. Cl.[2] ..... F41B 13/04

[52] U.S. Cl. ..... 224/2 B; 42/1 R

[58] Field of Search ..... 224/2 B, 2 C, 1 R, 5 R; 42/1 R

[56] References Cited

U.S. PATENT DOCUMENTS

| | | | |
|---|---|---|---|
| 2,001,321 | 5/1935 | Benns | 224/2 B |
| 3,763,587 | 10/1973 | Firmalino | 224/2 C |
| 3,804,306 | 4/1974 | Azanin | 224/2 B |
| 4,055,015 | 10/1977 | Musgrave | 224/2 B |

*Primary Examiner*—Trygve M. Blix
*Assistant Examiner*—Kenneth W. Noland

[57] ABSTRACT

A holster arranged to expedite charging a pistol of the type charged by relative motions between a slide and a frame. The pistol can be inserted into the holster in two different orientations. In one of the said orientations it can be inserted uncharged. By partly withdrawing it from the holster it can be rotated to the second orientation. If it is then pushed into the holster, the slide engages against an abutment thus causing the first charging stroke. Withdrawal of the pistol from the holster then allows the recoil spring in the pistol to accomplish the second charging stroke. This abstract is prepared to facilitate searching and it is not intended to constitute a limitation on the invention.

8 Claims, 5 Drawing Figures

PISTOL CHARGING HOLSTER

For safety reasons it is preferable to carry automatic or semiautomatic pistols with their hammers down, until firing seems necessary. Some pistols have a "double-action" mechanism which permits firing when the hammer is down by a long pull on the trigger. But, for the first shot, many pistols require that the hammer, if down, be cocked manually.

Furthermore, many users prefer to carry the pistol with the firing chamber empty. In this condition, when firing is to begin, it is necessary to manually draw back the slide and release it. This will charge a cartridge from the magazine into the firing chamber, and if the hammer happens to be down, the slide will push it to the cocked position. In an emergency the elapsed time for charging can be significant, and it normally requires use of two hands.

It is an object of this invention to provide a holster adapted both for transportation of a pistol and for charging it when desired, using only one hand.

This and other objects of the present invention will be apparent upon reference to the following specification, taken in connection with the accompanying drawings, wherein.

Figure 1:
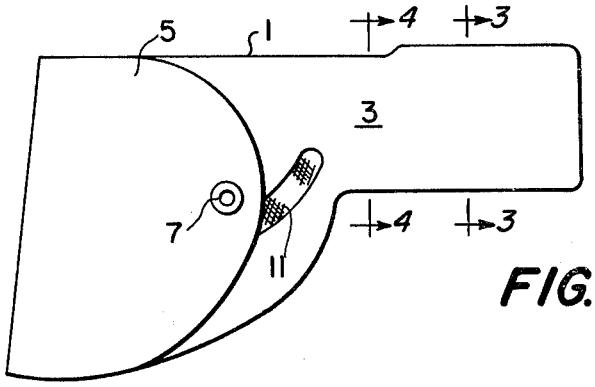
FIG. 1 is a side view of a pistol charging holster.

The illustrations are for purpose of disclosure and they should not be considered as limiting the invention. No particular pistol is shown in the drawings, as the invention can be used with various models, including some differing in configuration from that illustrated. It should also be understood that in actual practice, the holster would be made compatible in size, details, and overall configuration with the pistol or pistols with which it is to be used. The holster illustrated happens to have a closing flap, but the invention could be used with an open holster as well.

Referring now to the drawings in detail, FIG. 1 shows a side view of a holster 1 comprising a sheath 3, a flap 5, a fastener 7, and an elastic portion 11 which forms part of the sheath.

Figure 2:
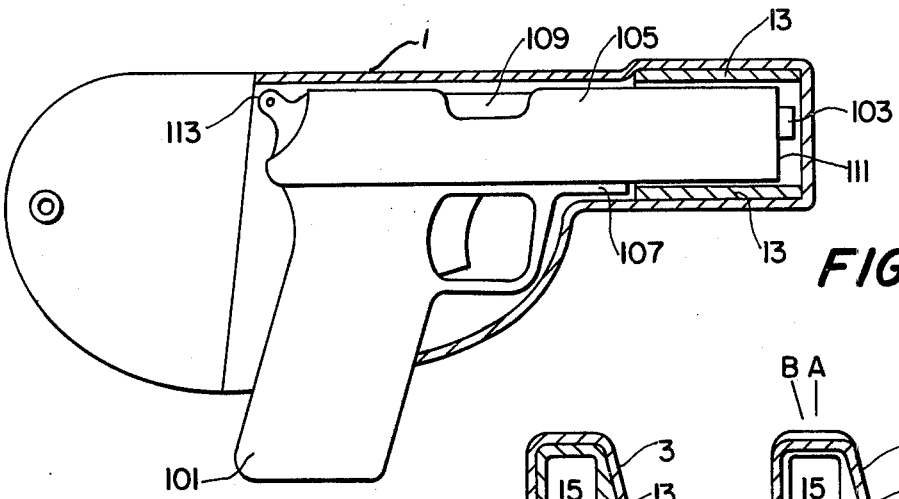
FIG. 2 is a longitudinal section of the same holster, with a pistol inserted therein.

In FIG. 2 the flap is open and the holster is sectioned. Within the holster is positioned a pistol comprising a grip 101, a barrel 103, a slide 105, a frame 107, an ejection port 109 in said slide, and a hammer 113. This pistol shown is of the prior art.

FIG. 2 also shows, in section, a block 13 positioned in the right portion of sheath 3, which is the lower portion when the holster is suspended from the person of a user. The holster is provided with typical suspension means, not visible in the drawings.

Figure 3:
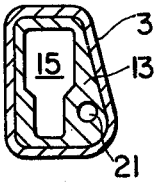
FIG. 3 is a cross section taken in the plane indicated by line 3—3 on FIG. 1.
Figure 4:
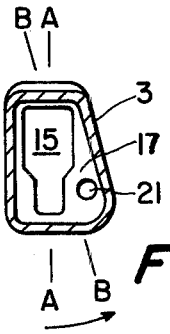
FIG. 4 is a cross section taken in the plane indicated by line 4—4 on FIG. 1.

As may be seen in FIGS. 3 and 4, block 13 includes a recess 15 which is made with a shape substantially similar to the front profile of slide 105, thereby allowing a portion of the slide to enter the recess, as in FIG. 2. The front profile of the slide is not visible in the drawings, but recess 15 represents a front profile substantially as seen on many slides.

It should be understood that the pistol appearing in FIG. 2 is inserted into the holster with its vertical axis oriented substantially on line A—A in FIG. 4.

Figure 5:
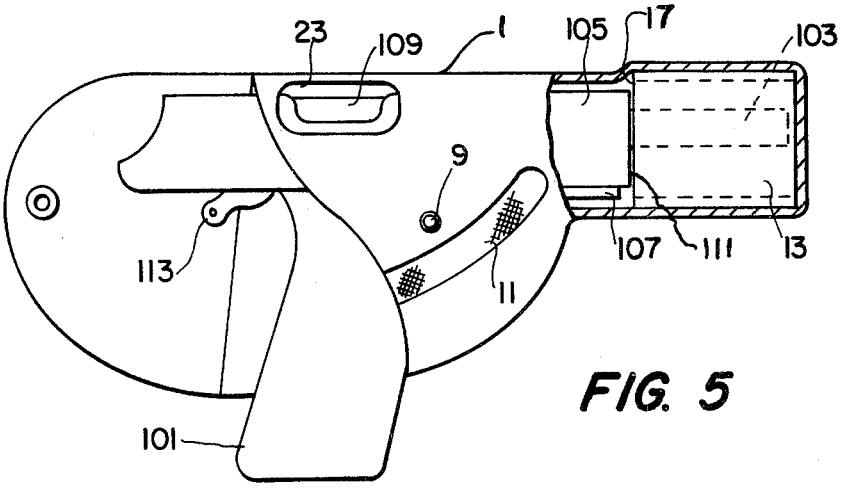
FIG. 5 is a partial longitudinal section of a charging holster with a pistol therein in the process of being charged.

As may be seen in FIGS. 4 and 5, one face of block 13 constitutes a ledge or abutment 17, which is offset to one side of recess 15. The abutment is used to charge the pistol in a manner which will be described below.

Assuming the pistol to be installed in the holster as shown in FIG. 2, when it is desired to charge, the pistol is drawn partly out of the sheath until the front face 111 of the slide is out of recess 15. The pistol is then rotated until its vertical axis is susbtantially oriented with line B—B in FIG. 4. This rotation is indicated by the curved arrow below FIG. 4.

The pistol is again pushed into the holster causing a portion of front face 111 of the slide to engage abutment 17 as shown in FIG. 5. Movement of the slide is thus arrested while grip 101, frame 107 and barrel 103 continue to move relative to the slide and the holster. Barrel 103, protruding from the front of the slide enters recess 15, and hammer 113 is cocked by the slide in the usual manner. The length of the block is so chosen as to permit the proper length of charging stroke.

The pistol is then withdrawn from the sheath. The second charging stroke is thereby accomplished by the recoil spring in the pistol in the well-known manner. The hammer will thus be cocked, and if the magazine contains cartridges, one will be rammed into the barrel by the slide during the second stroke. The pistol is then ready to fire and, if desired, it can be inserted into the holster with its vertical axis aligned with line A—A as previously described. With the holster suspended from the person of a user, the pistol can thus be charged using only one hand.

Button 9 in the sheath can cooperate with fastener 7 to keep the flap closed when desired. Flexible portion 11 is incorporated into the sheath to permit the vertical axis of the pistol to be rotated easily from orientation A—A to orientation B—B.

A hole 23 is provided in the sheath, so located as to be in registration with ejection port 109 when the slide is engaged with abutment 17. In the event that charging is accomplished when a cartridge is already in barrel 103, it will be ejected through port 109 and hole 23. If the hole was not provided, such a cartridge would be unable to leave port 109 and the pistol would jam. As may be seen in FIG. 1, flap 5 can cover hole 23 when necessary.

Some pistols have a guide rod for a recoil spring so arranged that the rod must protrude through the front face of the slide during charging. The rod is usually located below and parallel to the barrel. To accommodate such a rod during charging, a hole 21, or equivalent means, can be provided in abutment 17. The exact size, shape, and location of such means will depend on the characteristics of the piece it must accommodate.

Some pistols are arranged so that the front face of the slide must be drawn back beyond the front face of the frame during charging. To accommodate such a pistol, abutment 17 can have a recess adapted to permit the frame to enter therein a suitable distance.

As may be seen in FIG. 5, sheath 3 can block access to the trigger of a pistol therein during charging. Blocking access prevents the user from pulling the trigger until the pistol is ready.

The parts of a charging holster can be made of any suitable materials such as leather, plastics, wood, metals, textiles, rubber, or others. Furthermore, by careful choice of dimensions and shape, charging holsters can be made which are capable of use with more than one model of pistol.

A charging holster can be so dimensioned relative to the size and shape of the pistol that a flap, such as 5 in FIG. 1, cannot be completely closed when the slide of the pistol is engaged with the abutment. This may be seen in FIG. 5.

The disclosed charging holster will have a high degree of safety against unintentional charging. The act of charging requires several distinct movements in different directions, which are unlikely to occur unintentionally, in the proper sequence.

What I claim is:

1. A charging holster for a pistol charged by a first and a second movement of a frame relative to a slide, comprising: a sheath arranged for suspension from the person of a user, said sheath being adapted for insertion of said pistol completely therein in a first orientation without causing said first or said second movement; and said sheath also being adapted for insertion of said pistol therein in a second orientation whereat rigid abutment means fixed in said sheath can engage said slide at the front of the pistol to accomplish said first movement during said insertion.

2. A charging holster as set forth in claim 1 wherein said pistol can be moved from said first orientation to said second orientation while partly inserted into said sheath.

3. A charging holster as set forth in claim 1 wherein a portion of said sheath is elastic.

4. A charging holster as set forth in claim 1 wherein said abutment is adapted to accommodate a recoil spring guide protruding from the front of said slide during charging.

5. A charging holster as set forth in claim 1 wherein said sheath is adapted to block access to a trigger of said pistol when said frame is fully inserted into said sheath.

6. A charging holster as set forth in claim 1 wherein said sheath has a hole therein adapted to register with an ejection port in said slide when said slide is engaged with said means in said sheath.

7. A charging holster as set forth in claim 6 further provided with means for covering said hole.

8. A charging holster as set forth in claim 1 further provided with a flap which is prevented from closing by said slide when said slide is engaged with said means.

* * * * *